US012465100B2

(12) United States Patent
Gibbons

(10) Patent No.: US 12,465,100 B2
(45) Date of Patent: Nov. 11, 2025

(54) SYSTEM AND METHODS FOR GARMENT ACCESSORIZING

(71) Applicant: Michael P. Gibbons, Burr Ridge, IL (US)

(72) Inventor: Michael P. Gibbons, Burr Ridge, IL (US)

( * ) Notice: Subject to any disclaimer, the term of this patent is extended or adjusted under 35 U.S.C. 154(b) by 0 days.

(21) Appl. No.: 18/483,831

(22) Filed: Oct. 10, 2023

(65) Prior Publication Data

US 2024/0032632 A1 Feb. 1, 2024

Related U.S. Application Data

(63) Continuation of application No. 17/179,658, filed on Feb. 19, 2021, now Pat. No. 11,832,664, which is a continuation-in-part of application No. 15/053,706, filed on Feb. 25, 2016, now abandoned.

(51) Int. Cl.
*A41D 27/08* (2006.01)
*A41D 27/20* (2006.01)

(52) U.S. Cl.
CPC ..... *A41D 27/08* (2013.01); *A41D 27/20* (2013.01)

(58) Field of Classification Search
CPC ..... A41D 27/08; A41D 27/20
See application file for complete search history.

(56) References Cited

U.S. PATENT DOCUMENTS 2,417,786 A * 3/1947 Smith ..... A41D 27/20 D3/206
2,508,075 A * 5/1950 Morris ..... B43K 23/001 401/89
2,523,804 A * 9/1950 Albro ..... B43K 23/001 2/250
2,530,453 A * 11/1950 Eagle ..... A44C 15/004 D2/857
2,546,084 A * 3/1951 Berman ..... A41D 27/20 2/247
2,644,991 A * 7/1953 Albro ..... B43K 23/001 206/37
2,790,420 A * 4/1957 Zelinger ..... B43K 23/001 401/52
3,015,107 A * 1/1962 Lippman ..... A41D 27/20 2/249

(Continued)

*Primary Examiner* — Alissa L Hoey
(74) *Attorney, Agent, or Firm* — Valauskas Corder LLC

(57) ABSTRACT

The present invention is directed to a system and methods by which a garment may be accessorized. Preferred embodiments of the present invention include one or more mountable accessorizing apparatus which may be shaped and/or shapeable to form one or more mounting surfaces for mounting the mountable accessorizing apparatus on the garment and to provide one or more display components which may be viewable for accessorizing the garment. Some embodiments may include attachment components which facilitate mounting the one or more mountable accessorizing apparatus on the garment. Attachment components may include friction pads, magnets, pressure-sensitive adhesive, and/or hooks. The one or more display components may be viewable to accessorize the garment such as through color, pattern, and/or texture. In some embodiments, the system may include one or more supplemental modules which may supplement mounting and/or accessorizing.

7 Claims, 6 Drawing Sheets

(56) References Cited

U.S. PATENT DOCUMENTS 3,051,962 A * 9/1962 Lippman ..... G09F 3/00 40/586
3,280,488 A * 10/1966 Rubin ..... G09F 3/00 2/249
3,295,235 A * 1/1967 Tauber ..... G09F 3/185 224/230
3,320,620 A * 5/1967 Weidler ..... A63B 47/001 224/919
3,370,370 A * 2/1968 Lippman ..... G09F 21/02 D2/857
3,371,829 A * 3/1968 Phillips ..... G09F 3/185 283/77
5,184,375 A * 2/1993 Hoyt ..... B42D 5/006 24/3.12
5,210,881 A * 5/1993 Stocker, Jr. ..... A41D 27/20 2/244
5,249,437 A * 10/1993 Cole, Jr. ..... A45C 1/06 63/12
5,369,899 A * 12/1994 Reeves ..... G09F 7/12 40/621
5,448,806 A * 9/1995 Riceman ..... H01F 7/0263 24/303
5,473,799 A * 12/1995 Aoki ..... E05C 19/16 24/66.1
5,867,874 A * 2/1999 Simpson ..... B43K 23/001 24/3.12
6,216,279 B1 * 4/2001 Ellingson ..... A41D 27/08 2/239
6,339,866 B1 * 1/2002 French ..... A41D 27/08 40/594
6,659,321 B2 * 12/2003 Hartranft ..... B25H 3/00 224/230
6,694,526 B1 * 2/2004 Tate ..... A44C 1/00 24/3.12
7,069,745 B1 * 7/2006 Finley ..... A44C 7/009 63/14.7
7,854,021 B2 * 12/2010 Compton ..... A41D 27/08 2/243.1
7,980,012 B2 * 7/2011 Peterson ..... G09F 7/04 224/183
8,418,267 B2 * 4/2013 Shaw ..... G06Q 99/00 40/586
8,650,723 B2 * 2/2014 Reiter ..... A44B 17/0011 24/675
8,793,846 B2 * 8/2014 d'Auriac ..... A44C 25/001 24/66.1
8,959,725 B2 * 2/2015 Tam ..... A44B 6/00 24/351
8,973,166 B1 * 3/2015 Engle ..... A42B 1/0183 2/209.12
9,149,075 B2 * 10/2015 Kiker ..... A41B 15/02
9,341,285 B2 * 5/2016 Magno, Jr. ..... H02G 3/32
D761,001 S * 7/2016 Kouns ..... D2/895
9,596,889 B1 * 3/2017 Gambuzza ..... A41D 27/20
9,955,744 B1 * 5/2018 Yanes ..... A42B 1/248
10,092,144 B2 * 10/2018 Lebwohl ..... A41D 27/20
10,143,251 B2 * 12/2018 Kiker ..... G06Q 90/00
10,244,806 B2 * 4/2019 Marks ..... A41F 1/002
10,758,795 B2 * 9/2020 Choi ..... A63B 57/207
10,765,163 B2 * 9/2020 Svendsen ..... A42B 1/24
11,006,677 B2 * 5/2021 Jones ..... A41D 27/20
11,337,510 B2 * 5/2022 Stevens ..... A45F 5/02
11,464,300 B2 * 10/2022 Lewis ..... A44C 1/00
11,805,866 B2 * 11/2023 Zeman ..... A44C 1/00
11,832,664 B2 * 12/2023 Gibbons ..... A41D 27/08
11,978,366 B2 * 5/2024 Bruno ..... G09F 3/0297
2004/0159123 A1 * 8/2004 Mohs ..... A44C 1/00 63/1.11
2005/0044610 A1 * 3/2005 Grimes ..... A41D 1/06 2/244
2006/0236509 A1 * 10/2006 Ausman ..... A44B 5/02 24/303
2009/0049719 A1 * 2/2009 Compton ..... A41D 27/20 40/586
2009/0126073 A1 * 5/2009 Lovett ..... A41D 27/08 2/244
2009/0260395 A1 * 10/2009 Coleman ..... A44C 1/00 63/20
2010/0175168 A1 * 7/2010 Yari ..... A41D 1/06 2/244
2011/0004977 A1 * 1/2011 Port ..... G09F 21/02 2/246
2011/0056001 A1 * 3/2011 Missett ..... A41D 27/201 2/244
2011/0307420 A1 * 12/2011 Shaw ..... A41D 27/08 2/244
2012/0214013 A1 * 8/2012 Namsaraeva ..... H01F 7/0263 24/442
2012/0272434 A1 * 11/2012 VanNostran ..... A45C 13/08 2/244
2013/0042387 A1 * 2/2013 Kwon ..... A44B 1/32 2/244
2013/0042391 A1 * 2/2013 Hill ..... A45C 13/08 2/244
2014/0331388 A1 * 11/2014 Nunan ..... A42B 1/24 2/244
2015/0082667 A1 * 3/2015 Augustine ..... A43B 23/24 2/244
2015/0313300 A1 * 11/2015 Lawson ..... A41D 27/08 2/244
2015/0359278 A1 * 12/2015 Kiker ..... A41D 27/08 2/246
2016/0015101 A1 * 1/2016 Stefanovic ..... A41D 27/08 2/244
2018/0055120 A1 * 3/2018 Gall-Krasnick ..... A41F 17/00
2018/0125134 A1 * 5/2018 Price ..... A41B 1/08

* cited by examiner

SYSTEM AND METHODS FOR GARMENT ACCESSORIZING

CROSS REFERENCE TO RELATED APPLICATIONS

This application is a continuation of U.S. application Ser. No. 17/179,658 filed Feb. 19, 2021, which is a continuation-in-part of U.S. application Ser. No. 15/053,706 filed Feb. 25, 2016.

FIELD OF THE INVENTION

The present invention is generally directed to a simplified system and methods by which a garment may be accessorized. In certain embodiments, the system includes one or more mountable accessorizing apparatus that may be shaped or shapeable in order that the mountable accessorizing apparatus may be easily mounted on a garment. Advantageously, embodiments of the present invention may be used, for example, to accessorize a garment or to provide other information without damaging the garment.

BACKGROUND OF THE INVENTION

A garment typically is comprised of one or more components that are sized, shaped, or otherwise managed and connectable or connected to form a covering that may be worn over a surface of a body. Garments may be formed from one or more panels each of which may be generally planar in shape and made from one or more types of material or other components of varying size and shape. A garment may include one or more folds and one or more seams developed by joining one or more panels together. An edge may be a terminal boundary of one or more panels. To prevent fraying and overall to provide reinforcement, additional material may be added to an edge including through stitching.

The one or more components of a garment may be configured in various ways to provide protection, comfort, utility, and/or ornamentation. The components may also form or include an aperture. A buttonhole is one such aperture in one or more garment panels. The size and shape of the buttonhole is generally defined by one or more edges developed in the garment panel. In certain cases, the one or more edges may be reinforced by stitching. Another such aperture is that which is formed by a pocket. A garment pocket may be developed by attaching three sides of a smaller panel to a larger garment panel leaving one side edge of the panel unattached. The space between the pocket panel and the garment forms the aperture.

A garment, its features, and the material from which it is made produce a style, fashion, or look through color, pattern, and/or texture. However, wearers of garments at times apply, attach, affix, or otherwise wear belts, ties, scarves, jewelry, patches, and badges, or otherwise, that are intended to aid the functionality of and/or complement the appearance of the garments. Such an item associated or worn with a garment is often generically termed an "accessory". The process of adding an accessory to a garment is termed "accessorizing". The state of a garment with such an additional accessory is termed "accessorized".

Garments, however, include one or more other components to facilitate the attachment of one or more accessories to the garment. For example, pants often include loops so that belts may be attached to the waist area of the pants. In another example, a shirt may include a collar which may keep a tie properly positioned in place around the neck of a wearer. Accessories are often affixed to a garment through hooks, pins, stitching, or other means that may be permanent and/or may cause some permanent damage to the garment. Many such accessories may also be complicated and expensive.

There exists a need for a simplified system and methods by which a garment may be easily accessorized. The present invention solves this need. Advantageously, certain embodiments of the present invention may be used to accessorize a garment without damaging the garment.

SUMMARY OF THE INVENTION

The present invention is directed to a simplified system and methods by which a garment may be easily accessorized. In certain preferred embodiments of the present invention, the system includes one or more mountable accessorizing apparatus which may be shaped and/or shapeable to permit the apparatus to be mounted on the garment without causing damage to the garment and so that one or more display components are developed that may be viewable for accessorizing the garment and/or communicating information.

In certain preferred embodiments, the one or more mountable accessorizing apparatus may have one or more surfaces each of which may have one or more color, pattern, and/or texture features. The one or more mountable accessorizing apparatus may be shaped and/or shapeable to be mounted on the garment so that the one or more such surfaces are viewable as the one or more display components. In certain embodiments, the one or more display components may accessorize a garment and may communicate additional information through such color, pattern, and/or texture.

In some embodiments of the present invention, the one or more mountable accessorizing apparatus may include one or more attachment components that may facilitate the mounting of the apparatus on to a surface of a garment. Such attachment component may include one or more frictional surfaces, magnets, pressure-sensitive adhesives, and/or hooks. Such surface attachment of the apparatus may prevent the apparatus of the present invention from causing disruption to the construction of the garment when the apparatus is repeatedly applied to and removed from the surface of the garment.

Additional embodiments of the present invention may include one or more supplemental modules that may be attached or attachable to the one or more mountable accessorizing apparatus. In some embodiments, the one or more supplemental modules may attach to one or more supplemental mounting components to facilitate the mounting of the one or more mounting surface of the mountable accessorizing apparatus on the garment. In further embodiments, the one or more supplemental modules may have one or more supplemental display components to accessorize the garment such as through color, pattern, and/or texture.

One object of the present invention is to provide a simplified system and methods by which a garment may be accessorized.

Another object of the present invention is to provide a system including one or more mountable accessorizing apparatus which may be more easily mounted on a portion of a garment to provide one or more display components that may be viewable to accessorize the garment.

It is another object of the present invention to provide a system including one or more mountable accessorizing apparatus which advantageously may be releasably mounted on one or more surface portions of a garment for accessorizing the garment without damaging the garment.

It is yet another object of the present invention to provide a system including one or more mountable accessorizing apparatus having an initial shape that may be further shapeable in one or more configurations to form a mounting shape such that the one or more mountable accessorizing apparatus may be mounted on one of a plurality of portions of the surface of a garment.

The present invention, its attributes and advantages, may be further understood with reference to the detailed description of presently contemplated embodiments, taken in conjunction with the accompanying drawings.

BRIEF DESCRIPTION OF THE DRAWINGS

The preferred embodiments of the invention may be described in conjunction with the appended drawings provided to illustrate and not to limit the invention, where like designations denote like elements, and in which.

DETAILED DESCRIPTION

Preferred embodiments of the present invention are directed to a simplified system and methods by which a garment may be accessorized. The one or more mountable accessorizing apparatus may be shaped and/or shapeable to develop one or more mounting surfaces for mounting the apparatus on one or more surface portions of a garment and one or more display components which may be viewable to accessorize the garment including as through color, pattern, and/or texture.

In certain preferred embodiments, the mountable accessorizing apparatus may be formed from materials that are pliable, malleable, or otherwise shapeable, such as by a user, so that the mountable accessorizing apparatus may be easily shaped as needed to facilitate the mounting of the apparatus on a garment. Such materials include metal or plastic. Accordingly, certain embodiments of the mountable accessorizing apparatus may have an initial shape that may be further shapeable to develop one or more mounting shapes having one or more mounting surfaces to facilitate the mounting of the apparatus on the one or more surface portions of a garment.

Figure 1A:
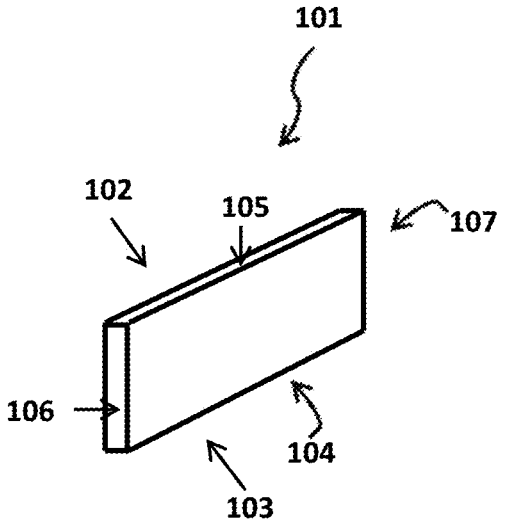
FIG. 1A illustrates a preferred embodiment of a mountable accessorizing apparatus according to the present invention.
Figure 1B:
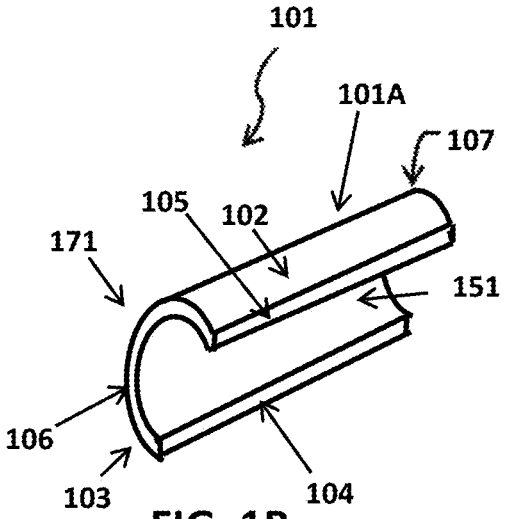
FIG. 1B illustrates a preferred embodiment of a shaped mountable accessorizing apparatus—such as the one shown in FIG. 1A—shaped to facilitate mounting.
Figure 1C:
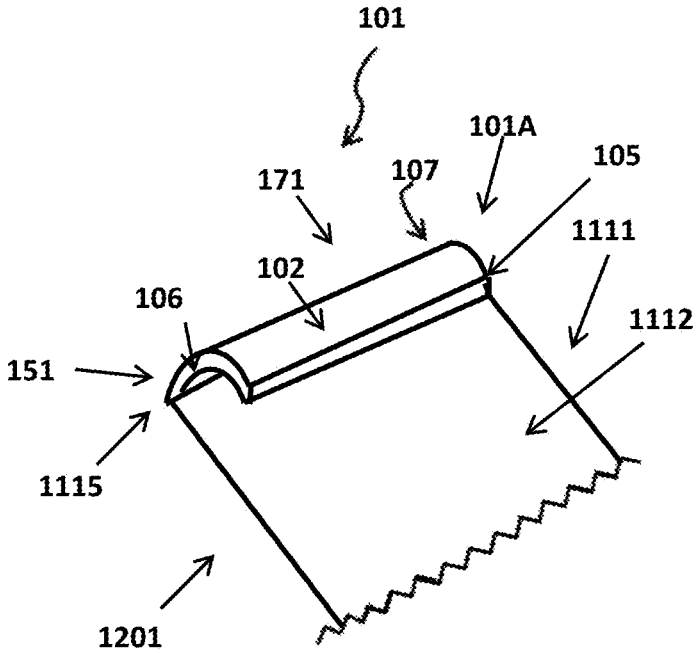
FIG. 1C illustrates a preferred embodiment of a shaped mountable accessorizing apparatus positioned for mounting on the surface of and adjacent to the surface of a pocket panel of a garment.

FIG. 1A, FIG. 1B, and FIG. 1C illustrate certain preferred embodiments of the present invention of a mountable accessorizing apparatus 101 that may be shaped and/or shapeable to develop one or more mounting surfaces for mounting the apparatus on one or more surface portions of a garment and one or more display components which may be viewable to accessorize the garment.

More specifically, the embodiment of a mountable accessorizing apparatus 101 illustrated in FIG. 1A has a generally rectangular prism initial shape. However, the mountable accessorizing apparatus 101 may have other initial shapes including circular, semi-circular, or triangular. The illustrated embodiment of the rectangular shaped apparatus 101 includes a first face surface 102 (not shown) opposing a second face surface 103, a first side surface 104 (not shown) opposing a second side surface 105, and a third side surface 106 opposing a fourth side surface 107 (not shown). Each such surface may have one or more color, pattern, and/or texture.

The mountable accessorizing apparatus 101 embodiment shown in FIG. 1A may be made from a plastic so that it is easily shaped—such as by a user—and so that the apparatus may be configured into a mounting shape having one or more mounting surfaces 151 to facilitate the mounting of the apparatus on one or more surface portions of a garment and such that one or a plurality of surfaces of the apparatus may be viewable as one or more display components 171. FIG. 1B illustrates a shaped mountable accessorizing apparatus 101A that includes a mounting surface 151 to facilitate the mounting of the shaped mountable accessorizing apparatus 101A on one or more surface portions of a garment and a display component 171 for accessorizing the garment.

FIG. 1C shows the preferred embodiment of the shaped mountable accessorizing apparatus 101A shown in FIG. 1B mounted on a garment 1201. More specifically, the shaped mountable accessorizing apparatus 101A is shown as mounted on the pocket surface 1112 of a pocket panel 1111 of the garment 1201. A pocket surface 1112 may include a front pocket panel surface 1113, a rear pocket panel surface 1114, and an upper edge surface 1115 all attached to a portion of a garment 1201. Depending on the configuration of the garment, and the position of the viewer or viewers, the shaped mountable accessorizing apparatus 101A may mount on the surface 1112 of the pocket panel 1111 so at least the first face surface 102 has been developed into a display component 171.

In some embodiments of the present invention, one or more mountable accessorizing apparatus 101 may include one or more attachment components to facilitate the mounting of the one or more accessorizing apparatus on the garment. The one or more attachment components may include one or more frictional element, magnet elements, pressure-sensitive adhesive elements, and/or hook elements.

FIG. 2A, FIG. 2B, FIG. 2C, and FIG. 2D illustrate other preferred embodiments of the present invention of a mountable accessorizing apparatus 101 which include one or more attachment components 108 for facilitating mounting the mountable accessorizing apparatus 101 on the surface of the garment. In some preferred embodiments, the mountable accessorizing apparatus 101 may be similar to or the same as the embodiment shown in FIG. 1A including a first face surface 102 (not shown) opposing a second face surface 103, a first side surface 104 (not shown) opposing a second side surface 105, and a third side surface 106 opposing a fourth side surface 107 (not shown). Each such surface may have one or more color, pattern, and/or texture. The mountable accessorizing apparatus 101 may be shapeable to develop a shaped mountable accessorizing apparatus 101A with one or more mounting surfaces 151 and so that the attachment components 108 may facilitate mounting the shaped mountable accessorizing apparatus 101A on one or more surface portions of a garment and to develop one or more display components 171.

Figure 2A:
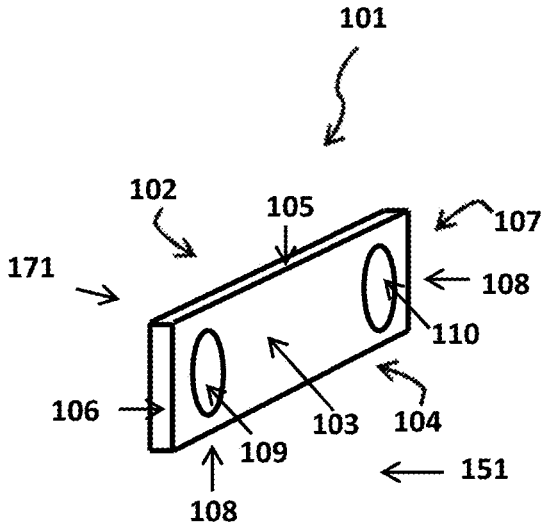
FIG. 2A illustrates a preferred embodiment of a mountable accessorizing apparatus including a certain preferred embodiment of an attachment component.

The embodiment of the mountable accessorizing apparatus 101 illustrated in FIG. 2A includes attachment components 108 on or forming a part of the second face surface 103. In the FIG. 2A embodiment, the attachment components 108 may be magnetic elements such as magnetically charged surfaces 109 and 110. In some embodiments, magnetically charged surfaces 109 and 110 may have the same polarity so that each is attracted to the same metallic material. In other embodiments, magnetically charged surface 109 may have a different polarity than magnetically charged surface 110 so that they may be attracted to each other. In certain embodiments, the mountable accessorizing apparatus 101 may be shaped to form a shaped mountable accessorizing apparatus 101A—such as by a user—so that magnetically charged surfaces 109 and 110 having opposite polarities are in proximity and spatially opposing each other to facilitate the mounting of the mounting surface 151 of the shaped mountable accessorizing apparatus 101A on one or more surface portions of a garment to develop one or more viewable display components 171 to accessorize the garment. In additional embodiments, magnetically charged surfaces 109 and 110 also may be located on one or more other surfaces.

Figure 2B:
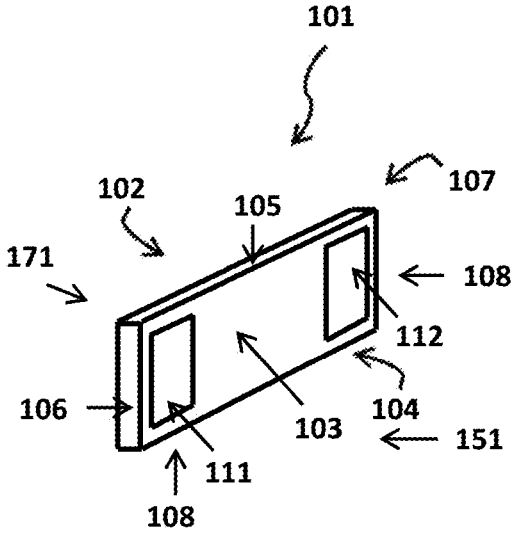
FIG. 2B illustrates a preferred embodiment of a mountable accessorizing apparatus including another certain preferred embodiment of an attachment component.

FIG. 2B illustrates a preferred embodiment of the mountable accessorizing apparatus 101 including a second face surface 103 having attachment components 108. In the FIG. 2B embodiment, the attachment components 108 may be pressure-sensitive adhesive elements such as pressure-sensitive adhesive strips 111 and 112. In some embodiments, pressure-sensitive adhesive strips 111 and 112 may have a non-adhesive cover which may be peeled away before mounting. In certain embodiments, the mountable accessorizing apparatus 101 may be shaped to form a shaped mountable accessorizing apparatus 101A—such as by a user—to be mounted on a garment by shaping the apparatus 101 so that the pressure-sensitive adhesive strips 111 and 112 contact one or more surface portions of a garment adhering to the one or more surface portions of the garment to facilitate the mounting of the mounting surface 151 of the mountable accessorizing apparatus 101A on the garment to develop one or more viewable display components 171 in order to accessorize the garment. In additional embodiments, pressure-sensitive adhesive strips 111 and 112 also may be located on one or more other surfaces.

Figure 2C:
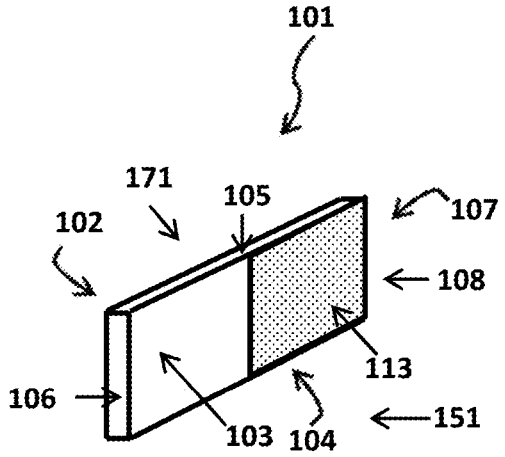
FIG. 2C illustrates a preferred embodiment of a mountable accessorizing apparatus including an additional certain preferred embodiment of an attachment component.

FIG. 2C illustrates a preferred embodiment of the mountable accessorizing apparatus 101 including a second face surface 103 having an attachment component 108. In the FIG. 2C embodiment, the attachment component 108 may be a frictional surface 113. In the FIG. 2C embodiment, the frictional element 113 is shown as covering approximately half the second face surface 103. In some embodiments, the frictional element 113 may be comprised of a material which may cause increased friction of the mountable accessorizing apparatus to a garment. In other embodiments, the frictional surface 113 may have a texture which causes increased friction of the mountable accessorizing apparatus to a garment. In certain embodiments, the mountable accessorizing apparatus 101 may be shaped to form a shaped mountable accessorizing apparatus 101A—such as by a user—by shaping the apparatus so the frictional element 113 contacts one or more surface portions of a garment increasing the friction between the apparatus and the one or more surface portions of the garment for facilitating the mounting of the mountable accessorizing apparatus 101 to develop one or more viewable display components 171 in order to accessorize the garment. In additional embodiments, one or more frictional element also may be located on one or more other surfaces.

Figure 2D:
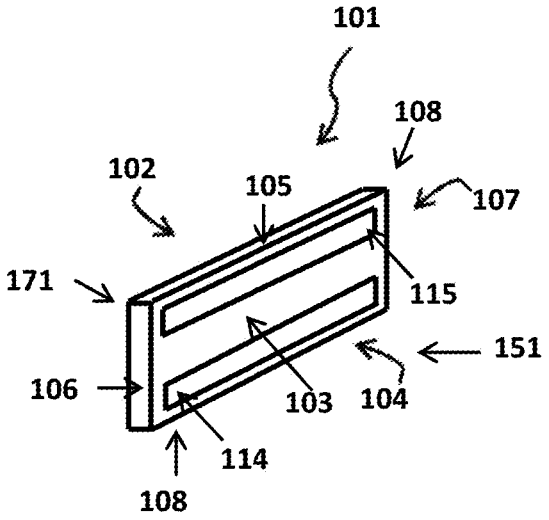
FIG. 2D illustrates a preferred embodiment of a mountable accessorizing apparatus including an added certain preferred embodiment of an attachment component.

FIG. 2D illustrates a preferred embodiment of the mountable accessorizing apparatus 101 including a second face surface 103 having attachment components 108. In the FIG. 2A embodiment, the attachment components 108 may be hooks 114 and 115. In the FIG. 2D embodiment, the hook elements 114 and 115 may be formed of a plurality of generally releasable hooks such as those forming elements of the Velcro™ system. In certain embodiments, the mountable accessorizing apparatus 101 may be shaped to form a shaped mountable accessorizing apparatus 101A— such as by a user—to place hook elements 114 and 115 in contact with one or more surface portions of the garment to facilitate mounting of the mounting surface 151 of the shaped mountable accessorizing apparatus 101A and develop one or more viewable display components 171 to accessorize the garment. In additional embodiments, one or more hooks also may be located on one or more other surfaces.

In certain preferred embodiments of the present invention, the one or more mountable accessorizing apparatus may be shaped or shapeable to be mounted on a pocket to develop one or more display components which may be viewable to accessorize the garment and/or communicate information.

Figure 3A:
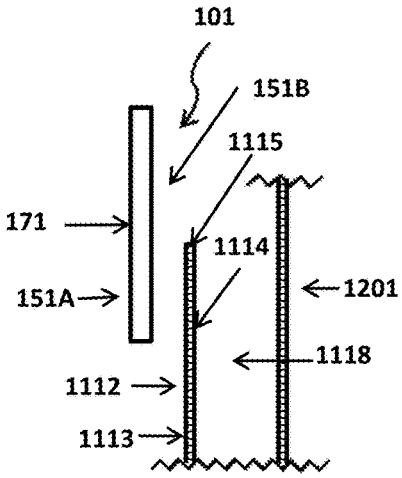
FIG. 3A illustrates a preferred embodiment of a mountable accessorizing apparatus positioned adjacent to and for mounting on a surface of the pocket panel of a garment (the elements of which are shown in cross section)

FIG. 3A illustrates another preferred embodiment of a mountable accessorizing apparatus 101 that may be shapeable to form a shaped mountable accessorizing apparatus 101A for mounting on one or more surface portions 1112 of a pocket panel surface 1112. In certain preferred embodiments, the mountable accessorizing apparatus 101 may be similar or the same as the embodiment illustrated in FIG. 1A or FIG. 2A. In the FIG. 3A embodiment, the mountable accessorizing apparatus 101 is positioned adjacent to a front pocket panel surface 1113 of the pocket panel surface 1112.

Figure 3B:
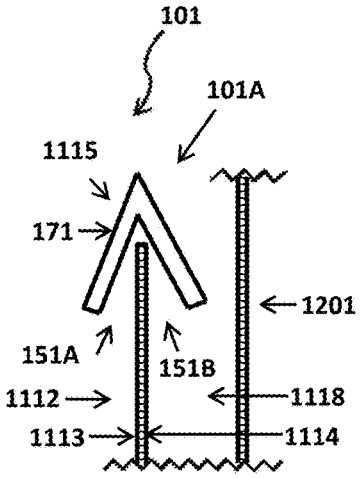
FIG. 3B illustrates a preferred embodiment of a shaped mountable accessorizing apparatus—such as the one shown in FIG. 3A—shaped and positioned adjacent to a pocket panel of a garment.

FIG. 3B illustrates a shaped mountable accessorizing apparatus 101A, shaped from the initial embodiment illustrated in FIG. 3A, with mounting surfaces 151A and 151B and a display component 171 so that the display component 171 of the shaped mountable accessorizing apparatus 101A is viewable to accessorize the garment 1201 such through color, pattern, and/or texture when mounted on the pocket. FIG. 3B shows the mountable accessorizing apparatus positioned adjacent to a front pocket panel surface 1113, the upper edge surface 1115, and/or the rear pocket panel surface 1114 of the pocket panel surface 1112.

Figure 3C:
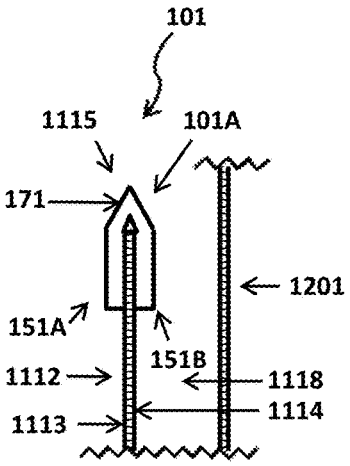
FIG. 3C illustrates a preferred embodiment of a shaped mountable accessorizing apparatus—such as the one shown in FIG. 3A and FIG. 3B—mounted on the unattached upper edge surface and over the front and the rear pocket panel surface.

FIG. 3C illustrates the shaped mountable accessorizing apparatus 101A as further mounted on the front pocket panel surface 1113, the upper edge surface 1115, and/or the rear pocket panel surface 1114 the pocket panel surface 1112. In the FIG. 3C embodiment, the mounting surfaces 151A and 151B are in contact with the front pocket panel surface 1113 and the pocket panel rear surface 1114 of the pocket panel surface 1112. A display component 171 may be viewable to accessorize the garment such as through color, pattern, and/or texture.

Certain embodiments of the present invention may include one or more supplemental modules. In certain embodiments, the supplemental module may have one or more supplemental display components which may accessorize a garment such as through color, pattern, and/or texture. In other embodiments, the supplemental module may attach to one or more supplemental attachment components.

Figure 3D:
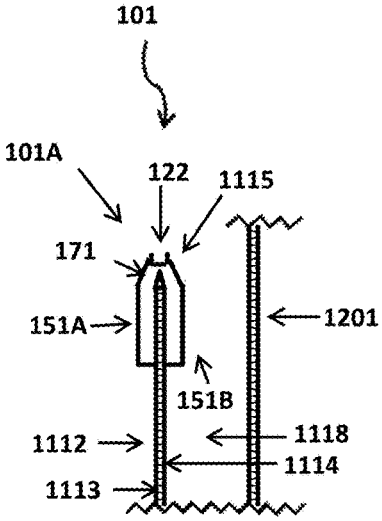
FIG. 3D illustrates a preferred embodiment of a shaped mountable accessorizing apparatus that includes a supplemental attachment component mounted on and over the upper edge surface, and the front and the rear pocket panel surface.

FIG. 3D illustrates an embodiment of a shaped mountable accessorizing apparatus 101A having a supplemental attachment component 122 to facilitate attachment of a supplemental module 121 to the mountable accessorizing apparatus 101. In some embodiments, the supplemental attachment component 122 may be sized and shaped to fit a portion of a supplemental module 121 so that the supplemental module 121 may be attached to the mountable accessorizing apparatus 101. In some embodiments, the supplemental attachment component 122 may include one or more magnets, pressure-sensitive adhesive components, or other attachment elements to facilitate attachment.

Figure 3E:
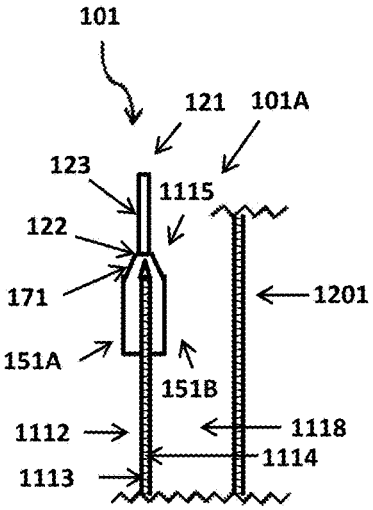
FIG. 3E illustrates a preferred embodiment of an additional module attached to a shaped mountable accessorizing apparatus all mounted on the unattached upper edge surface and over the front and the rear pocket panel surface.

FIG. 3E illustrates an embodiment of a shaped mountable accessorizing apparatus 101A including a supplemental module 121 attached to the shaped mountable accessorizing apparatus 101A by a supplemental attachment component 122. In some embodiments, the supplemental module 121 may include one or more magnets positioned for facilitating attachment to the supplemental attachment component 122. In other embodiments, the supplemental module 121 may include pressure-sensitive adhesive which may attach to supplemental attachment component 122. Further, the supplemental module 121 may have a supplemental display component 123 which may be viewable for accessorizing a garment such as through color, pattern, and/or texture.

In certain preferred embodiments of the present invention, one or more mountable accessorizing apparatus may be shaped or shapeable such that a portion may be inserted within and/or adjacent to an aperture and mounted on an edge surface to provide one or more display components which may be viewable for accessorizing the garment 1201. FIG. 4A-FIG. 4F illustrate preferred embodiments of a mountable accessorizing apparatus 101 that includes an initial shape and size which may be further shaped as a shaped mountable accessorizing apparatus 101 for reception within and/or adjacent to an aperture 1118 of a garment 1201. A buttonhole is defined by the size and shape of an edge surface 1119 surrounding the aperture 1118 within a garment 1201.

Figure 4A:
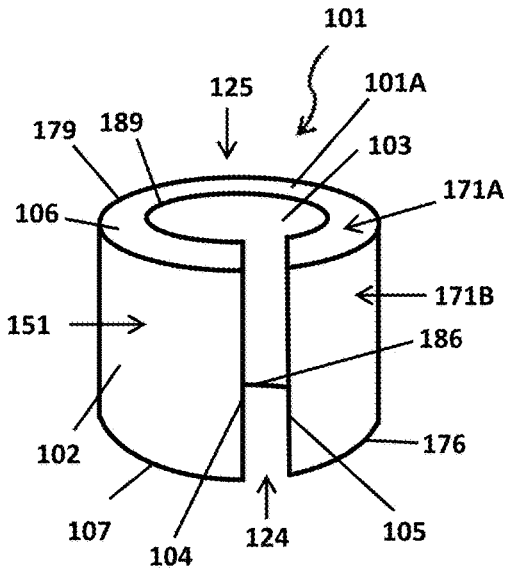
FIG. 4A illustrates a preferred embodiment of a shaped mountable accessorizing apparatus—such as the one shown also in FIG. 1A, FIG. 2A, and FIG. 3A—shaped so it may be received within and/or adjacent to a generally circular shaped aperture of a garment.

The embodiment of a shaped mountable accessorizing apparatus 101 shown in FIG. 4A is a rectangular prism body 101A shaped in a cylindrical-like form so that it may be received within and/or adjacent to a generally circular shaped aperture of a garment, e.g., buttonhole. Body 101A of apparatus 101 includes six rectangular faces 102, 103, 104, 105, 106, 107 and is formed so that third side surface 106 and fourth side surface 107 define parallel circular bases joined by curved surfaces 102, 103. The first side surface 104 and the second side surface 105 form a linear gap 124 where the curved surfaces 102, 103 split.

First face surface 102 meets the third side surface at 106 at top outer edge boundary 179 and meets the fourth side surface 107 at bottom outer edge boundary 176. Second face surface 103 meets the third side surface at 106 at top inner edge boundary 189 and meets the fourth side surface 107 at bottom inner edge boundary 186.

In some embodiments, the cylindrical-like shaped mountable accessorizing apparatus 101 may have an initial shape similar to the embodiment shown in FIG. 1A or FIG. 4A and may be formed from materials by which it may be further shapeable. In certain embodiments, a portion of the shaped mountable accessorizing apparatus 101 shown in FIG. 4A may be sized and shaped so that it may be inserted into an aperture 1118 of a garment 1201.

In some embodiments of the invention, a linear gap 124 is formed by the first side surface 104 and the second side surface 105 where the curved surfaces 102, 103 split. Specifically, the first side surface 104 opposes the second side surface 105, which are parallel to one another and positioned at a distance from each other. The linear gap 124 is perpendicular to and extending through both the third side surface 106 and the fourth side surface 107.

In some embodiments, the mountable accessorizing apparatus 101 may include a gap 124 which may permit the mountable accessorizing apparatus 101 to be adjustable in size and shape so that it may be insertable in an aperture 1118 of a garment 1201.

Figure 4B:
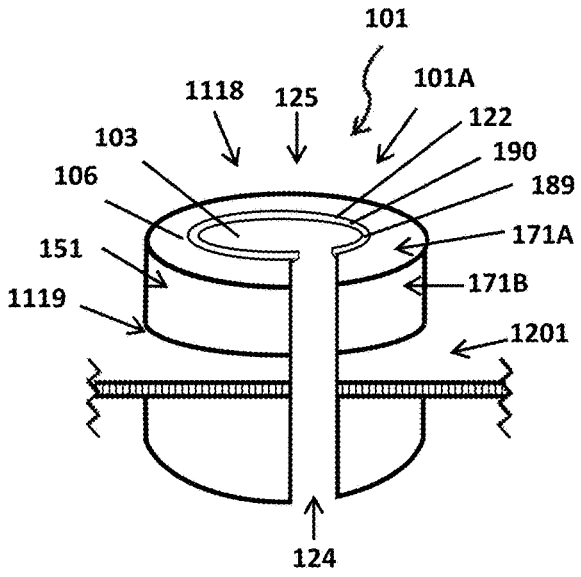
FIG. 4B illustrates a preferred embodiment of the shaped mountable accessorizing apparatus—such as the one shown also in FIG. 1A, FIG. 2A, FIG. 3A, and FIG. 4A—mounted on the edge surface defining an aperture of a garment.

FIG. 4B illustrates the shaped mountable accessorizing apparatus 101 inserted within and/or adjacent to an aperture 1118 of a garment 1201 and expanded so that a mounting surface 151 attaches to the edge surface 1119 surrounding the aperture 1118. Display components 171A and 171B may be viewable to accessorize the garment 1201 such as through color, pattern, and/or texture. As shown more specifically in FIG. 4B, the supplemental attachment component 122 is positioned at the edge boundary 189. In this embodiment, the supplemental attachment component 122 is a channel element 190. The channel element 190 extends between the first side surface 104 and the second side surface 105.

Figure 4C:
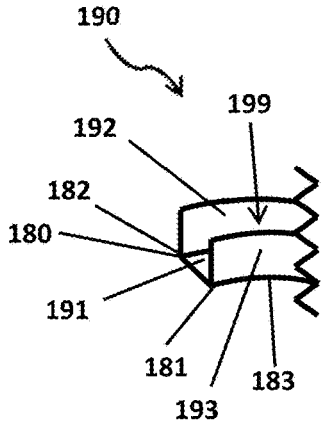
FIG. 4C illustrates an enlarged portion of the channel element shown of the shaped mountable accessorizing apparatus shown in FIG. 4B.

FIG. 4C illustrates an enlarged portion of the channel element 190 shown in FIG. 4B. The channel element 190 is defined by a base wall 191, a first wall 192 and a second wall 193. The base wall 191 is parallel to the third side surface 106, and includes a first edge 180 and a second edge 181. The first wall 192 includes a first boundary 182 and the second wall 193 includes a second boundary 183. Both the first wall 192 and the second wall 193 extend perpendicular from both the third side surface 106 and the base wall 191. The first edge 180 meeting the first boundary 182 and the second edge 181 meeting the second boundary 183. The walls 191, 192, 193 form a cavity 199. The cavity 199 of the channel element 190 is configured to receive supplemental module 121 as shown in FIG. 4D.

In some embodiments, the one or more mountable accessorizing apparatus may be shaped or shapeable to include or form an apparatus aperture 125 for receiving an object. Advantageously, the apparatus aperture 125 may reduce the damage that may be caused to the garment by the abrasion of the object with the garment. For example, a mountable accessorizing apparatus may be mounted on and/or adjacent to the edge surface of the buttonhole to lessen the likelihood that the edge surface of the buttonhole may be damaged from abrasion by the insertion of an object such as a flower into the buttonhole.

Figure 4D:
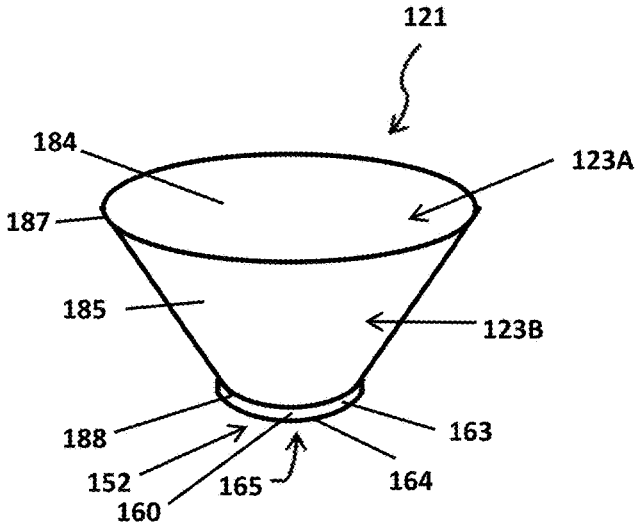
FIG. 4D illustrates a supplemental module attachable to the mountable accessorizing apparatus.
Figure 4E:
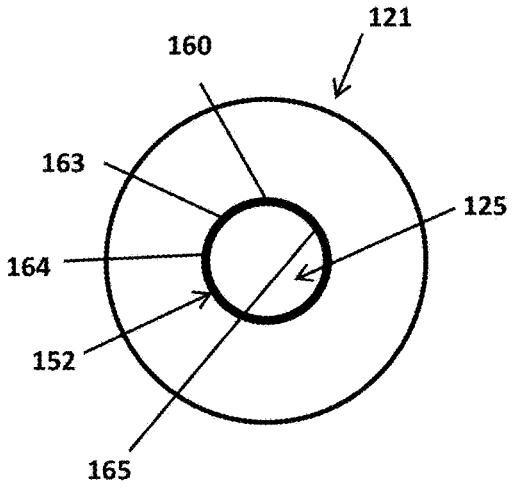
FIG. 4E illustrates a bottom view of the supplemental module.

FIG. 4D illustrates a supplemental module 121 according to one embodiment of the invention. The supplemental module 121 comprises exterior surface 185 extending between a first edge 187 and a second edge 188. As shown, the first edge 187 has a first diameter that is larger than a second diameter of the second edge 188 such that the exterior surface 185 is tapered between the first edge 187 and a second edge 188. It is also contemplated that first edge 187 and second edge 188 have the same diameters such that the exterior surface 185 is linear between the edges 187, 188.

It is also contemplated that embodiments of the supplemental module 121 may include circular surface 184. The circular surface 184 is attached to the first edge 187 of the exterior surface 185 and may include supplemental display components 123A viewable to present color, patterns, and/or texture. Exterior surface 185 may also include display component 123B on exterior surface 185.

The supplemental module 121 includes a supplemental attachment component 152 configured to cooperate with attachment component 122 of apparatus 101. The supplemental component 152 is a protrusion 160 positioned at edge 188 and includes an exterior face 163, bottom face 164, and interior face 165. The supplemental attachment component 152 is shown more specifically in the bottom view of the supplemental module 121 according to FIG. 4E.

Figure 4F:
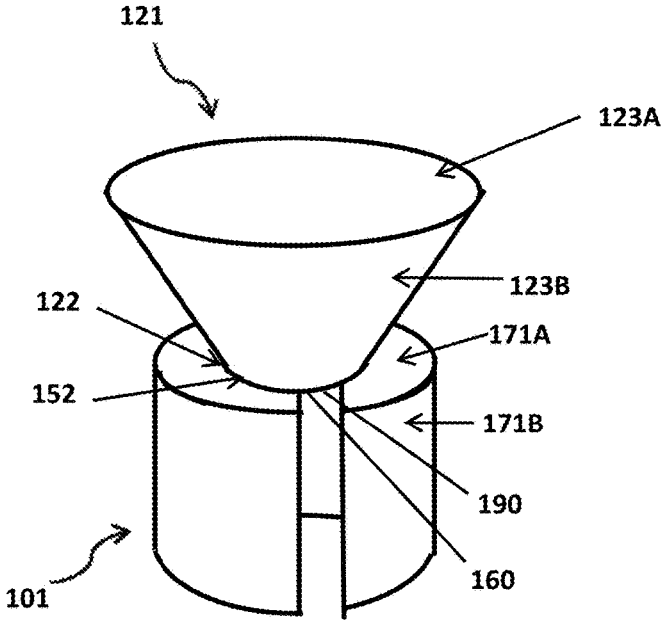
FIG. 4F illustrates a preferred embodiment of the supplemental module attached to a shaped mountable accessorizing apparatus—such as the one shown in FIG. 4A.

FIG. 4F illustrates a preferred embodiment of the supplemental module 121 attached to a shaped mountable accessorizing apparatus 101—such as the one shown in FIG. 4A. Supplemental attachment component 122 is sized and shaped to fit a portion of supplemental attachment component 152 of supplemental module 121 so that the supplemental module 121 may be attached to the mountable accessorizing apparatus 101. Specifically, channel element 190 receives protrusion 160 so that the base wall 191 is located on bottom face 164, first wall 192 is aligned with exterior face 152, and second wall 193 is aligned with interior face 165.

The shaped mountable accessorizing apparatus 101 including supplemental module 121 may be mounted on a garment 1201 to provide a supplemental display components 123A or 123B which may be viewable with the display components 171A and 171B to accessorize the garment 1201 such as through color, pattern, and/or texture. In other embodiments, the supplemental display components 123A, 123B may be attached such that display components 171A and 171B are not viewable.

In certain embodiments (e.g., without circular surface 184), the mountable accessorizing apparatus 101 may be configurable to permit an object may be inserted into an apparatus aperture 125 while the mountable accessorizing apparatus 101 with supplemental module 121 is mounted on the garment 1201. In some embodiments, the mountable accessorizing apparatus 101 may be molded or formed with the supplemental module 121.

In certain alternative embodiments, the one or more mountable accessorizing apparatus may be torus-like shaped so that a user may mount the torus-like shaped apparatus on the edges defining an aperture of a garment to provide one or more display components with may be viewable for accessorizing the garment.

Figure 5A:
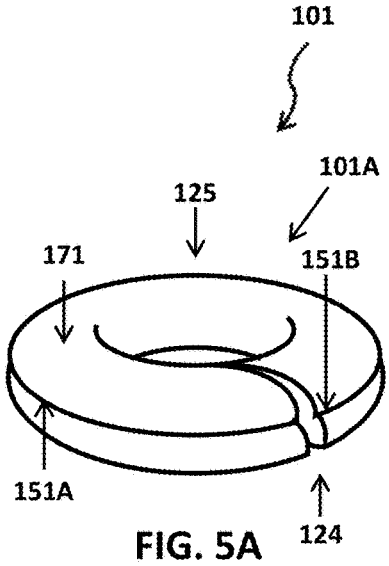
FIG. 5A illustrates a preferred embodiment of a shaped mountable accessorizing apparatus having a torus-like shape.
Figure 5B:
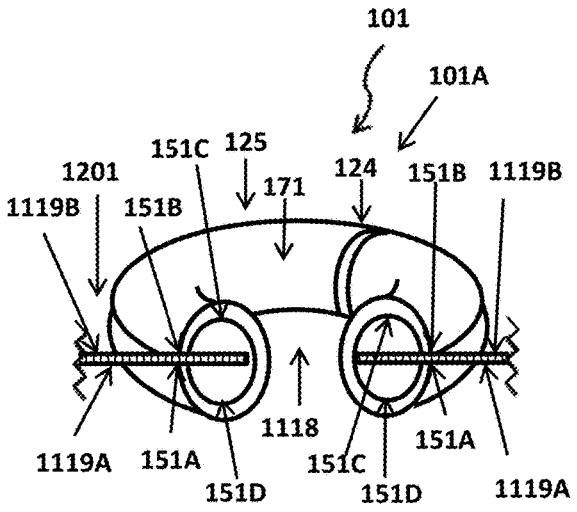
FIG. 5B illustrates a sectional view of the torus-like shaped mountable accessorizing apparatus—such as shown in FIG. 5A—mounted the edge surface surrounding an aperture.
Figure 5C:
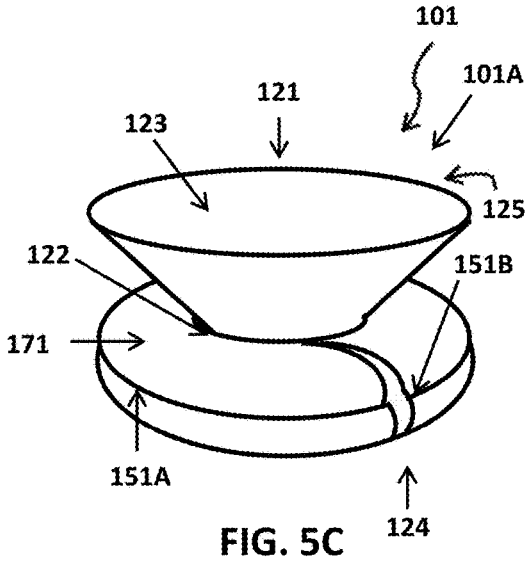
FIG. 5C illustrates a preferred embodiment of an additional module attached to a shaped mountable accessorizing apparatus.

FIG. 5A, FIG. 5B, and FIG. 5C illustrate additional embodiments of a torus-like shaped mountable accessorizing apparatus 101A to be mounted—such as by a user—on the edge surface 1119 surrounding an aperture 1118. The torus-like shaped mountable accessorizing apparatus 101A may be formed from a flexible material so that the mountable accessorizing apparatus 101A size may be adjusted to facilitate insertion in an aperture 1118.

FIG. 5A illustrates a preferred embodiment of torus-like shaped mountable accessorizing apparatus 101A which may be shaped and/or shapeable such as by a user. In some embodiments, the torus-like shaped mountable accessorizing apparatus 101A may be pre-shaped similar to the embodiment shown in FIG. 1A, FIG. 4A or FIG. 5A and further shapeable. The illustrated torus-like shaped mountable accessorizing apparatus 101A may be shaped so that a display component 171 may be viewable to accessorize a garment such as through color, pattern, and/or texture. The torus-like shaped mountable accessorizing apparatus 101A may include one or more elements to facilitate shaping of the mountable accessorizing apparatus 101A such as a gap 124 by which the torus-like shaped mountable accessorizing apparatus 101A may be more easily shaped.

FIG. 5B illustrates a sectional view of the torus-like shaped mountable accessorizing apparatus 101A as mounted on edge surface 1119A and 1119B of a buttonhole to develop an apparatus aperture 125 and a display component 171 that may be viewable. The FIG. 5B illustrated embodiment includes mounting surfaces 151A and 151B that are mounted on the surfaces of the edge surface 1119A and 1119B of the buttonhole. In some embodiments, the torus-like shaped mountable accessorizing apparatus 101A may be compressed so that mounting surface 151C and 151D may contact the surface of the garment 1201. In some embodiments, the mounting surfaces 151A and 151B may include hook elements attached to the edge surface 1119A and 1119B.

In FIG. 5C, a supplemental module 121 is attached to the torus-like shaped mountable accessorizing apparatus 101A by a supplemental attachment component 122. The torus-like shaped mountable accessorizing apparatus 101A may be mounted on a garment 1201 so that a supplemental display component 123 may be viewable with the display component 171 to accessorize the garment 1201 such as through color, pattern and/or texture. In some embodiments, the supplemental display component 123 may conceal the display component 171 so it is not viewable. The torus-like shaped mountable accessorizing apparatus 101A attached to the supplemental module 121 may include one or more elements to facilitate shaping of the mountable accessorizing apparatus 101A such as a gap 124 by which the mountable accessorizing apparatus 101A to be more easily shaped.

In certain embodiments, an object may be inserted into an apparatus aperture 125 while the torus-like shaped mountable accessorizing apparatus 101A with supplemental module 121 is mounted on the garment 1201. In some embodiments, the supplemental module 121 may attach to the mountable accessorizing apparatus 101A. In other embodiments, the mountable accessorizing apparatus 101 may be molded or formed with the supplemental module 121.

Preferred embodiments of the present invention may be directed to a method or methods for accessorizing a garment including steps for shaping one or more mountable accessorizing apparatus and mounting the one or more mountable accessorizing apparatus to provide one or more display components of the one or more mountable accessorizing apparatus which may be viewable.

While the disclosure is susceptible to various modifications and alternative forms, specific exemplary embodiments of the invention have been shown by way of example in the drawings and have been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

The invention claimed is:

1. A mountable accessorizing apparatus shapeable to be mounted on a pocket of a garment, the pocket comprising a front pocket panel surface, an upper edge surface, and a rear pocket panel surface, the apparatus comprising:

a body comprising a first mounting surface opposing a second mounting surface, the apparatus formed over the pocket such that a first portion of the first mounting surface contacts the front pocket panel surface, a second portion of the first mounting surface contacts the upper edge surface, and a third portion of the first mounting surface contacts the rear pocket panel surface, the second portion comprising a channel element, wherein the channel element is defined by a base wall, a first wall, and a second wall, the base wall parallel to the upper edge surface of the pocket, and both the first wall and the second wall extending perpendicular from the base wall forming a cavity, a supplemental module comprising an exterior face, a bottom face, and an interior face, the cavity of the channel element receives the supplemental module so that the bottom face is located on the base wall, the supplemental module positioned parallel to the front pocket panel surface and the rear pocket panel surface, and in vertical alignment with the upper edge surface of the pocket.

2. The mountable accessorizing apparatus according to claim 1, wherein the bottom face of the supplemental module comprises a supplemental attachment component.

3. The mountable accessorizing apparatus according to claim 2, wherein the supplemental attachment component comprises one or more magnets or pressure-sensitive adhesive components.

4. The mountable accessorizing apparatus according to claim 1, wherein one or more display components are located on the exterior face of the supplemental module.

5. The mountable accessorizing apparatus according to claim 4, wherein the one or more display components are selected from the group comprising: a color, a pattern, a texture.

6. The mountable accessorizing apparatus according to claim 1, wherein both the base wall of the channel element and the bottom face of the supplemental module include magnetic elements with magnetically charged surfaces.

7. The mountable accessorizing apparatus according to claim 6, wherein the magnetic charged surface of the base wall being a polarity different from a polarity of the magnetic charged surface of the bottom surface.

* * * * *